United States Patent [19]

Seitz et al.

[11] 4,375,286

[45] Mar. 1, 1983

[54] ELECTRONIC GAME APPARATUS

[75] Inventors: Adolf Seitz, West Chicago; John West Buras, Chicago, both of Ill.

[73] Assignee: D. Gottlieb & Co., Northlake, Ill.

[21] Appl. No.: 288,491

[22] Filed: Jul. 30, 1981

[51] Int. Cl.[3] ..... A63F 7/02; A63F 9/22

[52] U.S. Cl. ..... 273/121 A; 273/DIG. 28; 273/313

[58] Field of Search ..... 273/DIG. 28, 121 A, 273/54 C

[56] References Cited

U.S. PATENT DOCUMENTS 4,131,948 12/1978 Kaenel ..... 273/54 C 4,239,219 12/1980 Haefliger ..... 273/121 A

OTHER PUBLICATIONS

"Volcano (Game #667) Instruction Manual", Gottlieb Amusement Games, pp. 1–42, 1981.

"New York, N.Y. Instruction Manual", Gottlieb Amusement Games, 1980.

*Primary Examiner*—Vance Y. Hum

*Assistant Examiner*—Mary Ann Stoll

*Attorney, Agent, or Firm*—Arnold, White & Durkee

[57] ABSTRACT

An electronic game apparatus comprising both video game play and pinball game play. Operation of the video game play is enabled by game play conditions of the pinball game play and visa versa. Video game play is implemented using a CRT supported by a housing common to the pinball game.

13 Claims, 4 Drawing Figures

Fig. 1
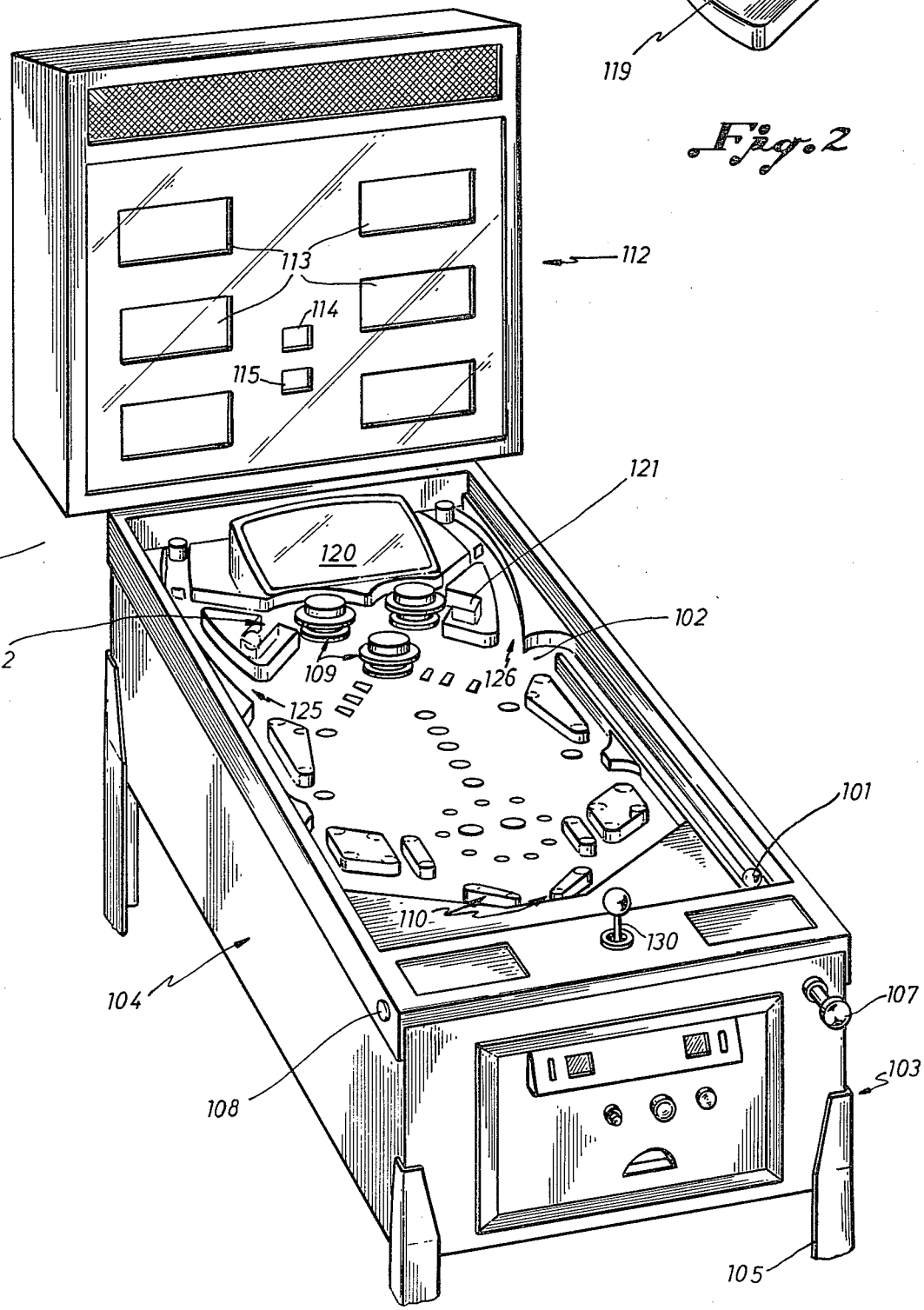
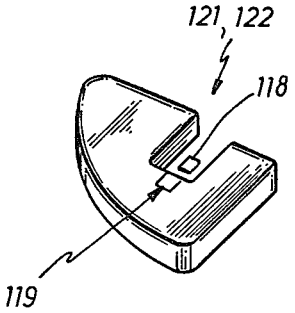
Fig. 2

ELECTRONIC GAME APPARATUS

BACKGROUND OF THE INVENTION

1. Field of the Invention

The present invention relates in general to electronic game apparatus, and, more particularly, to such apparatus comprising both pinball and video games.

2. Description of the Prior Art

Designers of electronic games constantly strive to provide innovations to continue the interest of the public in playing such games. In the case of pinball games, new drop-target and roll-over switch designs and new game strategies in general have been developed for attracting players and continuing the high interest in pinball. Recently, there have been proposals to innovate the playfield itself in an attempt to provide new attractions to the pinball player.

Video games are also available in the marketplace and have gained a substantial amount of popularity. Video games include a cathode ray tube (CRT) which provides the playfield for the game. Typical video games display a number of targets on the CRT which are engaged by a video ball, which is under the control of the player.

No known game apparatus has combined the features of pinball and video into a single game. This novel and useful result is provided by the present invention.

SUMMARY OF THE INVENTION

The present invention provides new and improved electronic game apparatus which integrates the features of pinball and video games into a single game. Such combination permits the player of the game to derive the recreational benefits of pinball and video games from a single integrated game.

According to one aspect of the invention, the pinball portion of the apparatus has a ball supporting playfield which defines a player position adjacent to the playfield and which is sloped upwardly away from the player position. The playfield has one or more flipper mechanisms disposed on it for propelling a ball or surface projectile away from the player to engage one or more targets on the pinball playfield. As the player engages the targets on the playfield, the apparatus operates to accumulate and display a score.

In accordance with another aspect of the invention, means are provided for participating in video play, dependent on the ball achieving a selected pinball condition during pinball play. In a presently preferred embodiment of the invention, such aspect is implemented by the player directing the ball into one of two captive areas on the playfield. Each captive area includes a detection element, e.g. a switch, which the ball engages while in the captive area. In this presently preferred embodiment, the game apparatus responds to engagement of the switch to disable the pinball portion of the game, when the player is participating in video play.

The player then participates in video play by using an operator actuable control, which may, for example, comprise a "joy stick". The operator-actuable control is used to guide the video ball to engage targets on the video playfield and thereby accumulate score.

In accordance with another aspect of the invention, means are provided for the player to again participate in pinball play responsive to the video ball achieving a selected video condition during video play. When such video condition is achieved by the player, the ball is ejected from the captive area and re-enters the pinball playfield. In a preferred embodiment, the pinball playfield is then activated for the player who has not been defeated in the video portion. For the player who has been defeated in the video game, the pinball playfield is not activated, when video play is concluded.

BRIEF DESCRIPTION OF THE DRAWINGS

In the accompanying drawings:

FIG. 1 is a perspective view of game apparatus in accordance with the present invention.

FIG. 2 is a perspective view of one of the captive areas of the pinball playfield shown in FIG. 1.

DETAILED DESCRIPTION OF A PREFERRED EMBODIMENT

Figure 3:
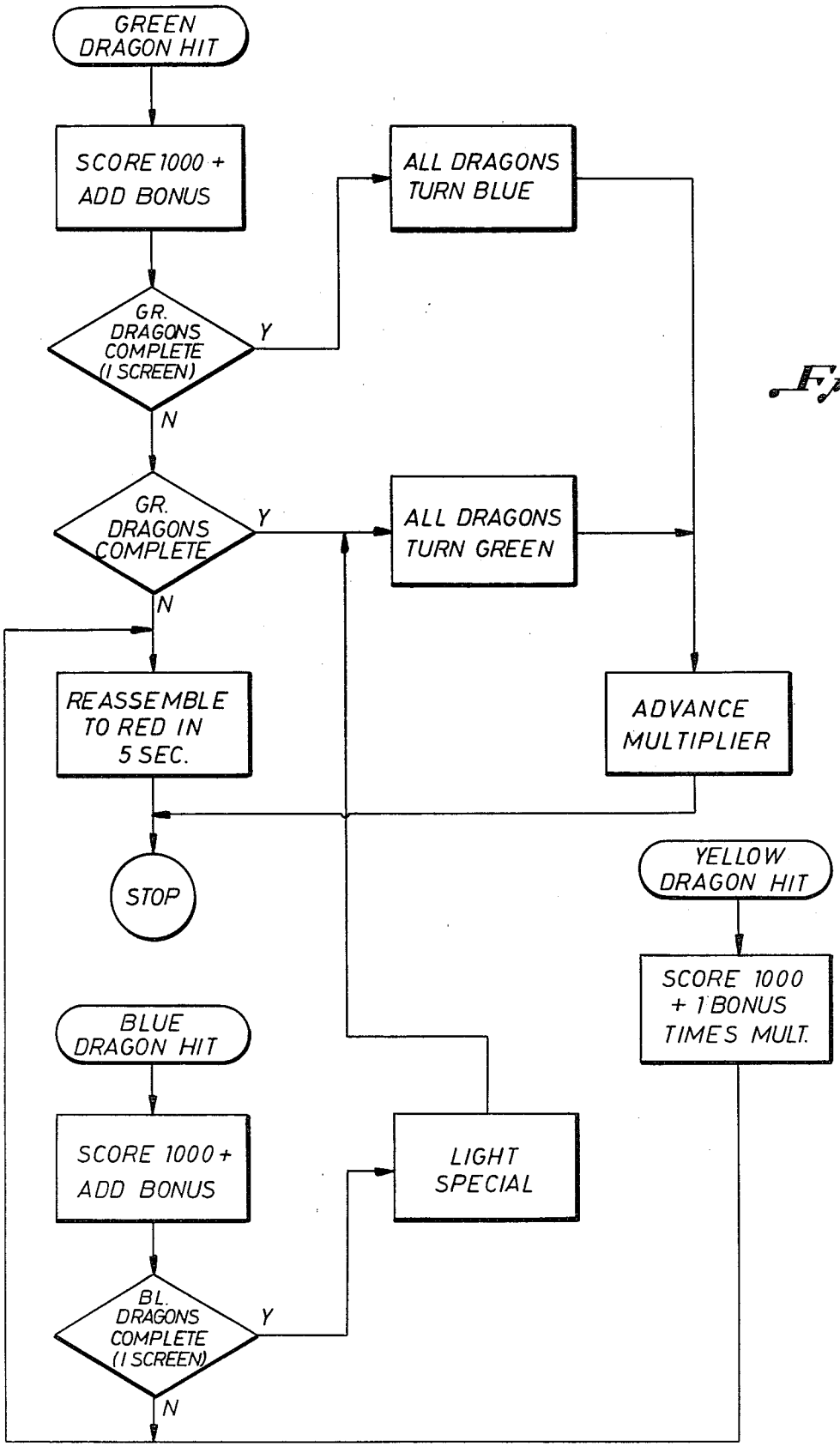
FIGS. 3 and 4 are flow diagrams which illustrate the operation of subroutines which are executed by a system controller during video play.

It will be appreciated that the present invention can take many forms and embodiments. One embodiment of the invention is illustrated and described to give an understanding of the invention. It should be understood that the following description is intended to be illustrative, and not limiting, of the invention.

With reference now to FIG. 1, game apparatus 100 is constructed and arranged according to the present invention. Apparatus 100 includes a pinball portion having playfield 102 for supporting a ball 101, which is sloped upward from the usual player position 103 for a pinball game. A cabinet 104 is provided for supporting the playfield 102, and a set of supporting legs 105 is provided for elevating the cabinet 104 to a height convenient to the player. A plunger or shooter 107 and a set of flipper control switches 108 are disposed in the cabinet 104 near the player position 103. Sets of pop-bumpers 109, flipper mechanisms 110, and other ball propelling devices such as sling shots, etc. are disposed in a conventional manner on the playfield 102. A conventional solenoid-operated outhole (not shown) is provided to return the ball to the shooter 107 when the ball is lost in play between the flipper mechanisms 110 or when the ball is returned to the pinball playfield after completion of unsuccessful video play as described below.

A back glass assembly 112 is supported at the end of cabinet 104 opposite the player position 103. The back glass assembly 112 has the usual pinball assemblies such as scoring displays 113, game tally display 114, and ball-in-play display 115.

Still referring to FIG. 1, apparatus in accordance with the present invention also comprises a video portion. As an outstanding feature of the invention, the pinball game and the video game are integrated physically into a single cabinet. Similarly the game play for the pingame and the video game is integrated so that one depends upon the other. The player is thus provided with the advantages and challenges of each game in a single game.

A cathode ray tube (CRT) 120 forms the playfield for the video portion. The CRT 120 is disposed on the playfield 102 at the opposite end of the cabinet 104 from the player position 103. The video portion of the apparatus in accordance with the present invention also includes an operator-actuable control for controlling video play and such operator-actuable control preferably takes the form of a manual "joy stick" 130, as shown in FIG. 1.

The playfield 102 includes two captive areas 121 and 122 for the ball 101, which captive areas are located near the CRT 120 as shown. It will be appreciated that the captive areas 121 and 122 may be located at other suitable locations in the playfield 102.

As shown in FIG. 2, each captive area 121,122 includes a switch 118, which is engagable by the ball 101. The engagement of switch 118 produces a signal, which is input to a system controller for changing operation of the game apparatus from pinball to video play, as described below. Each captive area 121, 122 also includes an ejector 119, which operates to eject the ball 101 from the captive area.

Apparatus in accordance with the present invention preferably includes a system controller employing a conventional microcomputer (not shown), which is programmed to control the operation of the game, as described below. Such microcomputer is preferably housed in the cabinet 104 underneath the playfield 102. A typical pinball game controller is that used by D. Gottlieb & Co., Northlake, Ill., for example in its current pinball games. Also, a typical video game controller is that used by D. Gottlieb & Co., for example in video games manufactured by it in the past. Although it is believed unnecessary for purposes of enabling disclosure, an instruction manual for Gottlieb's Volcano pinball game and an instruction manual for Gottlieb's New York, New York video game are specifically incorporated herein by reference to the extent necessary.

The operation of the present invention is now described. Upon initial activation, the microcomputer in the cabinet 104 operates to permit the player to participate in pinball play by enabling the playfield 102 of the pinball portion of the game. The ball 101 is then propelled onto the playfield 102 by the shooter 107, and engages the targets thereon. The player accumulates a score based on the engagement of said targets by standard pinball techniques. The score accumulated by the player during pinball play is displayed in one of the scoring displays 113.

In a preferred embodiment of the invention, the microcomputer operates to disable video play while the player participates in pinball play. However, it should be appreciated that the present invention is intended to embrace games which operate to permit video play and pinball play to proceed simultaneously.

To change from pinball play to video play, the operator directs the ball 101 into either captive area 121, 122. The signal produced by the ball 101 engaging the switch 118 in either captive area 121 or 122 is sensed by the microcomputer. The microcomputer responds to the engagement of either of those switches to permit video play to proceed. When video play is enabled, playfield 102 is preferably deactivated, i.e. disabled.

The player in the video portion of the game preferably controls a spot of light, i.e., a video ball, set amid a background on the CRT. The video ball may be guided by the operator with a joy stick 130 to engage one or more suitable targets which are displayed on the CRT 120. In a preferred embodiment of the present invention, the video play defines a kill-the-attacking-dragon theme. The CRT 120 initially displays a plurality of dragons of one color which are "hit" or "rolled over" by the video ball to score points. As the dragons of the first color are hit, they are destroyed and turn into dragons of a second (red) color, which try to catch and destroy the video ball. If the video ball is caught by a dragon of the second color at any time, the video ball is consumed, and video play is terminated. The pinball is then kicked from the captive hole by ejector 119. In this situation the pinball playfield 102 preferably remains deactivated, and the ball 101 exits the playfield 102 through an outhole (not shown). When the ball 101 again is shot onto playfield 102, the above process is repeated.

In a preferred embodiment of the invention, the video playfield includes "escape" areas, into which the video ball may be guided by the player by the joy stick 103. In these escape areas, the video ball is protected from destruction by the dragons of the second color. Entry of the video ball into an escape area causes video play to be terminated. Likewise, successful engagement of all targets on the video playfield causes video play to be terminated. In either of these situations, the kicker 113 ejects ball 101 onto the playfield 102. In these situations, however, playfield 102 is reactivated (enabled) and pinball play may be resumed. If the ball 101 again enters a captive area 121 or 122, video play is again enabled and pinball disabled. Video play commences in this situation with the same targets on CRT 120 as were present when video play was disabled.

As used herein the term "enable" shall mean to allow game play, either pinball or video, to proceed. The term "disable" shall mean to at least partially interrupt a game function, either a pinball or video game function, to prevent game play. For example, pinball play is "disabled" when the ball 101 is held in the captive areas 121, 122 regardless of whether the flippers, bumpers, etc. are activated or deactivated. Similarly, video play is "disabled" when the joy stick 130 no longer can control the video ball, regardless of whether background scenes remain on the CRT 120.

Figure 4:
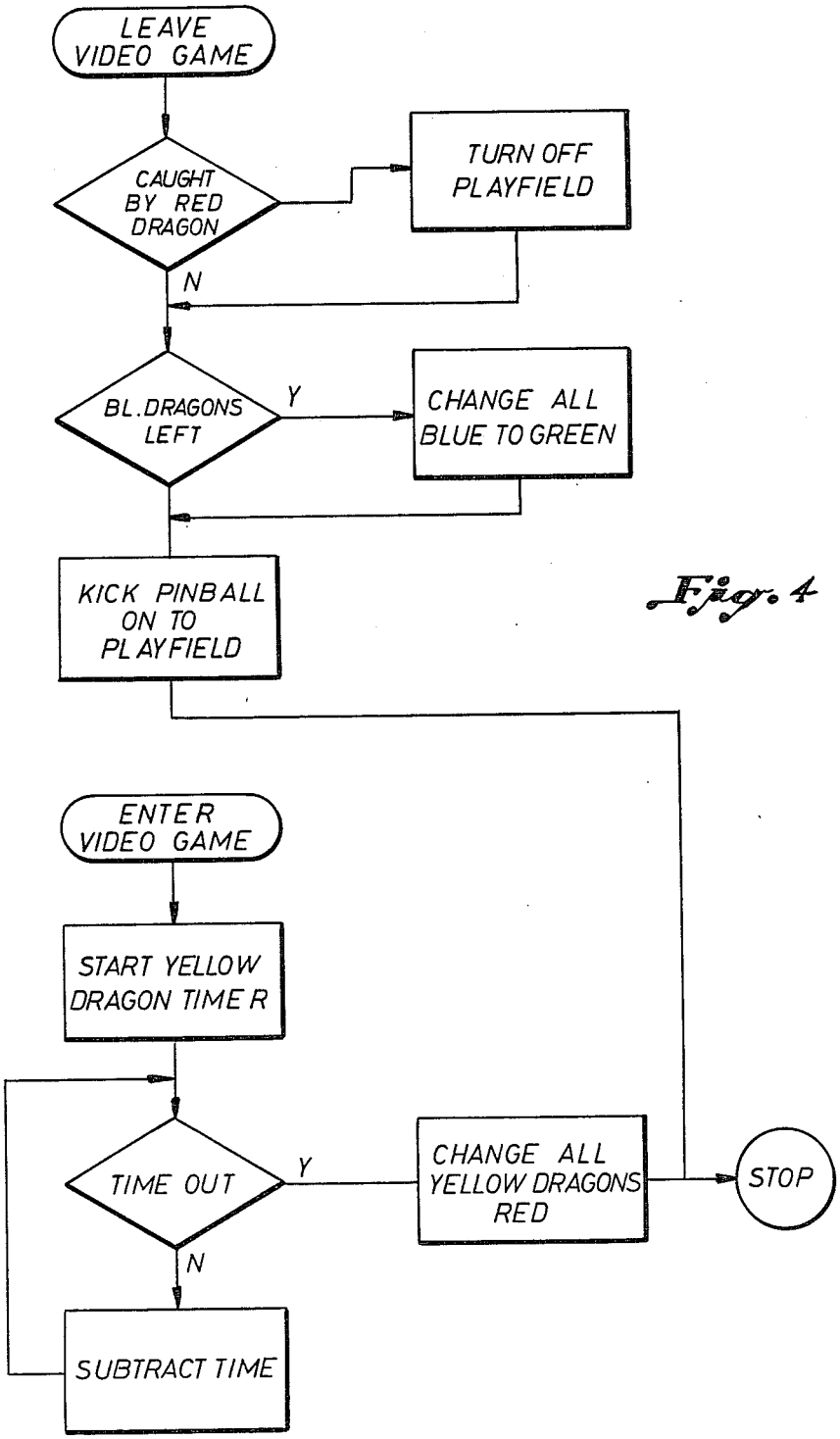

With reference now to FIGS. 3 and 4, there are shown flow diagrams which illustrate the operation of subroutines which are executed by the system controller (not shown) during video play.

What is claimed is:

1. The combination of a pinball game and a video game comprising:

(a) a housing;

(b) means supported by said housing for defining pinball play, including a ball and a playfield for supporting the ball, flippers for propelling the ball on the playfield and ball actuated devices on the playfield for effecting selected pinball conditions when engaged by the ball;

(c) means supported by said housing, including a video selected display, for defining video play, where operation of the video play means defines video conditions; and (d) means for enabling operation of said video play means dependent upon the ball achieving said selected pinball condition during pinball play to permit integrated pinball-video play.

2. The apparatus of claim 1 further comprising means for enabling operation of said pinball play means upon said selected video condition.

3. The apparatus of claim 2, wherein said pinball play enabling means includes a player controlled input mechanism.

4. The apparatus of claim 1 further comprising means responsive to selected ones of said pinball conditions for altering said video conditions during video play.

5. The apparatus of claim 4, wherein said altering means includes a ball capturing mechanism on said playfield.

6. The combination of a pinball game and a video game comprising:

(a) a housing;

(b) means supported by said housing for defining pinball play, including a ball and a playfield for supporting the ball, flippers for propelling the ball on the playfield and ball actuated devices on the playfield for effecting pinball conditions when engaged by the ball;

(c) means supported by said housing for defining video play, including a video display where an operation of the video play means defines selected video conditions; and (d) means for enabling operation of said pinball play means dependent upon said selected video condition to permit integrated pinball-video play.

7. The apparatus of claim 6, wherein said pinball play enabling means includes a player controlled input mechanism.

8. The apparatus of claim 6, further including means responsive to selected ones of said pinball conditions for altering said video conditions during video play.

9. The combination of a pinball game and a video game, comprising:

(a) a housing;

(b) means supported by said housing for defining pinball play, including a ball and a playfield for supporting the ball, flippers for propelling the ball on the playfield and ball actuated devices on the playfield for effecting pinball conditions when engaged by the ball;

(c) means supported by said housing, including a video display, for defining video play, where operation of the video play means defines selected video conditions, said video display including a video ball;

(d) at least one captive area on the playfield into which the ball may be directed by a player of the game, each said captive area including a switch which the ball engages when in the captive area;

(e) means in said housing for detecting the engagement of the switch in the captive area by the ball, and for enabling video play and disabling pinball play responsive to said engagement;

(f) operator-actuable control for guiding the video ball on the video playfield to engage targets thereon;

(g) means for disabling video play dependent on the video ball achieving a selected condition during video play; and (h) means for ejecting the ball from a captive area onto the playfield responsive to the disablement of video play.

10. The apparatus of claim 9 further comprising:

means for enabling pinball play upon the disablement of video play, when the player has not been defeated during video play.

11. The combination of a pinball game and a video game, comprising:

(a) a housing;

(b) means supported by said housing for defining pinball play, including a ball and a playfield for supporting the ball, flippers for propelling the ball on the playfield, and ball actuated devices on the playfield for effecting selected pinball conditions when engaged by the ball;

(c) means supported by said housing, including a video display, for defining video play, where operation of the video play means defines video conditions; and (d) means for disabling operation of the pinball play means and for enabling operation of said video play means dependent upon the ball achieving said selected pinball condition during pinball play.

12. The combination of a pinball game and a video game comprising:

(a) a housing;

(b) means supported by said housing for defining pinball play, including a ball and a playfield for supporting the ball, flippers for propelling the ball on the playfield and ball actuated devices on the playfield for effecting pinball conditions when engaged by the ball;

(c) means supported by said housing for defining video play, including a video display where an operation of the video play means defines selected video conditions; and (d) means for disabling operation of said video play means and for enabling operation of said pinball play means dependent upon said selected video condition.

13. The combination of a pinball game and a video game comprising:

(a) a housing;

(b) means supported by said housing for defining pinball play, including a ball and a playfield for supporting the ball, means for propelling the ball on the playfield, and ball actuated devices on the playfield for effecting pinball conditions when engaged by the ball;

(c) means supported by said housing, including a video display for defining selected video play, where operation of the video play means defines video conditions; and (d) means for operating said pinball play means and said video play means in response to the play condition of either the video play means or the pinball play means.

* * * * *

UNITED STATES PATENT OFFICE

CERTIFICATE OF CORRECTION

Patent No. 4,375,286 Dated March 1, 1983

Inventor(s) Adolf Seitz and John West Buras

It is certified that error appears in the above-identified patent and that said Letters Patent are hereby corrected as shown below:

In the title, change "ELECTRONIC GAME APPARATUS" to -- ELECTRONIC VIDEO AND PINBALL APPARATUS --.

Column 1, line 1, change "ELECTRONIC GAME APPARATUS" to -- ELECTRONIC VIDEO GAME AND PINBALL APPARATUS --.

Column 2, line 55, change "pinball game" to --pingame --.

Column 4, line 53, after "defining", insert --selected --.

Signed and Sealed this

Twenty-third Day of August 1983

[SEAL]

Attest:

GERALD J. MOSSINGHOFF

Attesting Officer

Commissioner of Patents and Trademarks